United States Patent [19]

Perry

[11] Patent Number: 4,502,719

[45] Date of Patent: Mar. 5, 1985

[54] LEVER DOOR HANDLE

[76] Inventor: Eugene H. Perry, 239 Irving, San Francisco, Calif. 94122

[21] Appl. No.: 482,505

[22] Filed: Apr. 6, 1983

[51] Int. Cl.[3] ..... E05C 13/00

[52] U.S. Cl. ..... 292/347

[58] Field of Search ..... 292/230, 236, 238, DIG. 23, 292/347, 1

[56] References Cited

U.S. PATENT DOCUMENTS

| | | | |
|---|---|---|---|
| 1,061,878 | 5/1913 | Smith | 292/236 |
| 2,306,867 | 12/1942 | Dean | 292/347 |
| 2,488,635 | 11/1949 | Martin | 292/347 |
| 3,960,396 | 6/1976 | Miyahara | 292/347 |

*Primary Examiner*—Richard E. Moore

*Attorney, Agent, or Firm*—Leonard Bloom

[57] ABSTRACT

An improved lever door handle that includes an outwardly extending moment arm, a handle body provided with a mass that opposes rotation of the moment arm so that upon release of the moment arm, the door knob will return to its at rest position.

19 Claims, 4 Drawing Figures

LEVER DOOR HANDLE

BACKGROUND OF THE INVENTION

The following relates generally to improved door handles adapted to universally replace those currently in existence for the benefit of the handicapped.

Only relatively recently has it been decreed that the handicapped, the infirm and the aged should be provided with the means to conduct substantially normal lives as it relates to public buildings, transportation and thoroughfares. To this end, many new construction plans require that provision be made for the handicapped.

One of the most nettlesome problems that handicapped people confront involves the manipulation of the common door. Conventional door knobs are substantially dome shaped and provide no true mechanical advantage for people whose hands are slippery, arthritic, or encumbered by carrying packages and the like. While some doors are provided with automatic closing devices so that the door will close behind oneself, the associated latch mechanisms are usually spring biased so that the door will relatch once it has been released and closed. It is frequently objectionable and sometimes difficult to assure that the door has been latched, especially when encumbered as above.

The following reflects the state-of-the-art of which applicant is aware, insofar as these citations appear germane to the process at hand.

| | | |
|---|---|---|
| 2,496,714 | Hanies | Feb. 7, 1950 |
| 3,960,396 | Miyahara | June 1, 1976 |
| 3,762,086 | Horbinski | Oct. 2, 1973 |
| 4,223,931 | Neary | Sep. 23, 1980 |

Neary teaches the use of a door knob attachment including a lever arm adapted to be attached to a conventional door knob so as to make the door easily operable by handicapped people and the like. The structure is suitably formed to be retrofitted on existing installations and contemplates continued use of the old door knob.

While Neary appears to have addressed the problem of an improved mechanical advantage when unlatching the door, a long felt yet heretofore unsatisfied need still exists in assisting that the relatching process continue in an unimpeded manner. It should be clear that with the provision of the additional mechanical advantage associated with the lever arm, there is a concomitant loss in the advantage that currently exists in springs that relatch the door automatically. Moreover, the spring latch that is associated with most doors suffers from spring fatigue as a function of time.

The remaining citations show the state-of-the-art further.

By way of contrast, the instant invention is distinguished over the known prior art in that an instrumentality has been provided which simultaneously improves the mechanical advantage by providing a radially extending lever arm emanating from the knob proper, and in addition the knob has been restructured so that a relatively massive weight is disposed on the side of the knob remote from the lever so as to provide a counter balancing effect. It has been determined that most people with sufficient mobility to actuate the lever can resist the counter balancing associated with the new and improved knob design, without undue hardship; but the counter balancing means associated with the instant application simultaneously provides an improved latching not obtainable by the known prior art.

SUMMARY AND OBJECT OF THE INVENTION

Accordingly, this invention has as an objective a provision of a new and novel lever door handle.

A further object of this invention contemplates providing a device as characterized above which increases the mechanical advantage associated with the operative manipulation of the door knob.

A further object contemplates providing a device as characterized above which does not negate the designed in effect of a latch return spring associated with many locks on the market today.

A further object of this invention contemplates providing a device as characterized above which includes a counter balancing instrumentality to assist the spring in the return latching mode.

A further object contemplates providing a device as set forth above which is easy to install, lends itself to mass production techniques, and is durable in use.

A further object contemplates providing a device as characterized above which is relatively inexpensive to manufacture.

A still further object of this invention provides a device as characterized above which tends to render less difficult overcoming the latch mechanism associated with the door knob.

A further object of this invention contemplates providing a device as characterized above which is compatible with existing lock cylinders.

It is still yet a further object of the present invention as characterized above which is aesthetically pleasing and can lend itself to deployment in a variety of decors.

These and other objects will be made manifest when considering the following detailed specification when taken in conjunction with the appended drawing figures wherein there has been provided a lever integrally formed with a door handle suitably fashioned for its facile manipulation by handicapped people or the like, the improved door handle including an instrumentality which returns the door handle to an inoperative position after manipulation of the lever, the handle having an interior provided with metallic reinforcement or the like to twart unauthorized tampering of the door handle, and is adapted to readily receive conventionally available lock cylinders and door stems that are currently on the market. In addition, the device provides an intrinsic instrumentality for assisting the latch spring mechanism of conventional doors in performing its function.

Other objects will be made manifest when considering the following detailed specification taken in conjunction with the appended drawing figures.

BRIEF DESCRIPTION OF THE DRAWING FIGURES

BRIEF DESCRIPTION OF THE PREFERRED EMBODIMENT

Figure 1:
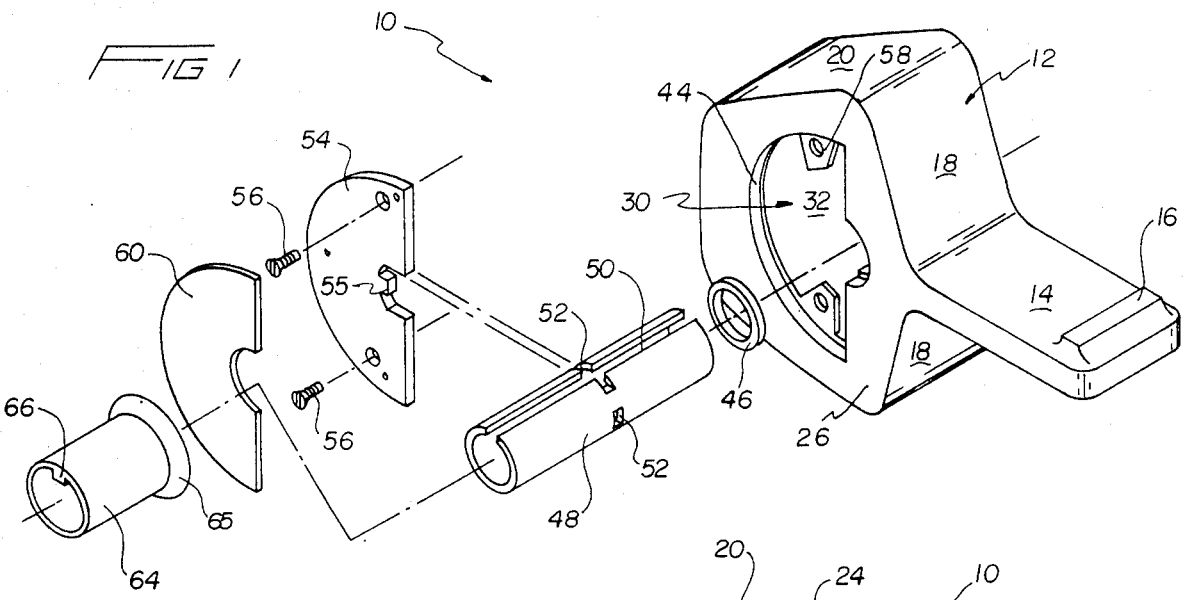
FIG. 1 is a perspective view with the exploded part showing the apparatus according to the present invention.

Referring to the drawings now, wherein like reference numerals refer to like parts of the various drawing figures, reference numeral 10 is directed to the lever door handle according to the present invention.

As shown in FIG. 1 for example, the lever door handle 10 includes a handle mass 12 of substantially pentagonal configuration and preferrably formed from cast plastic or its equivalent. Two planar faces 18 defining two sides of the pentagonal handle communicate with a radially extending moment arm 14, upper and lower terminal portions of the moment arm 14 including upwardly and outwardly extending bosses 16 provide a purchase area for the fingers of one's hand in manipulation of the device.

In turn, the two substantially planar faces 18 adjacent the moment arm 14 communicate with two arcuate faces 20 forming further sides of the pentagonal handle, and the two arcuate faces 20 share an end face 22 also of arcuate configuration.

Figure 2:
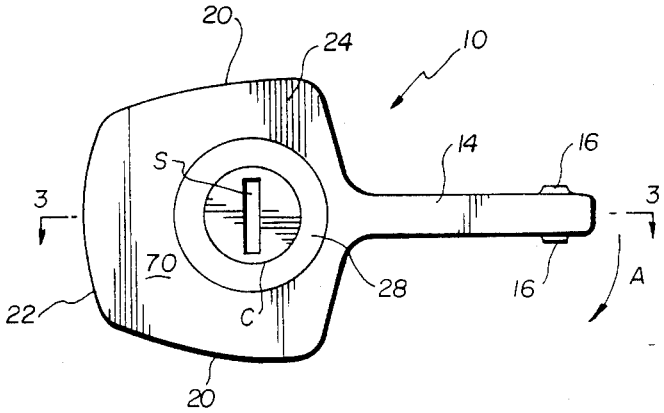
FIG. 2 is a front view thereof.

As shown in FIG. 2, a substantially planar front face 24 is provided and includes a beveled opening 28 that allows communication of a conventional cylinder C, associated key slot S or its equivalent to allow access by the person operating the handle.

Figure 3:
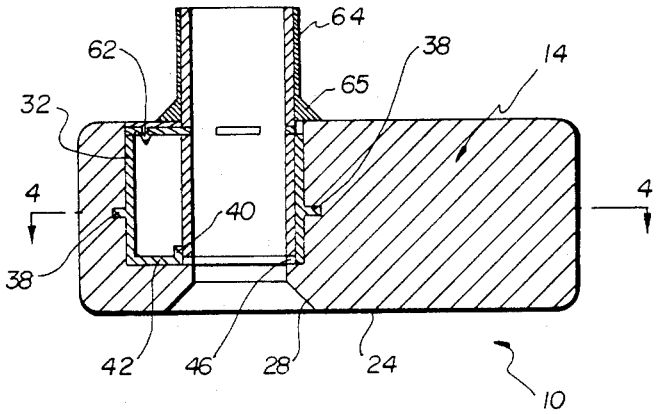
FIG. 3 is a sectional view taken along lines 3—3 of FIG. 2.
Figure 4:
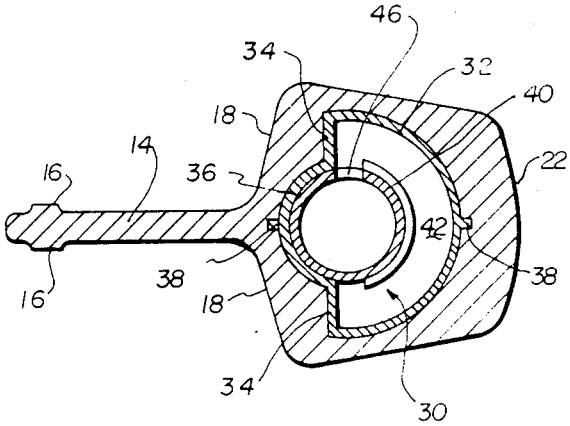
FIG. 4 is a sectional view taken along lines 4—4 of FIG. 3.

As shown in the drawing, a rear face 26 of the handle is also provided and includes an opening which allows access to the handle interior 30. More particularly, the interior 30 provides an area for reception therein of conventional door hardware and includes a metal housing 32 of substantially cylindrical configuration in combination with a substantially planar back wall 42. As shown in FIGS. 3 and 4, the handle housing 12 is cast about the metal housing 32 proper and retained thereon by means of casting lugs 38 interconnecting the two.

The semi-cylindrical metal housing 32 curves toward the two planar faces 18 and stops shortly therefrom, and the housing 32 includes two inwardly directing chord walls 34 which radiate inwardly each a third of the total distance, and thereafter curve back towards the moment arm 14 providing a spindle wall 36 to be defined shortly. As shown in FIG. 4, the planar front wall 42 of the metallic housing 32 is substantially C shaped.

A spindle 48 is provided adapted to be slidably received within the metal housing 32 of the door handle 10, and for this purpose, a guide ridge 40 is provided along the front wall 42 thereof. As shown in FIG. 4 thereof for example, the guide ridge 40 is of arcuate configuration and extends normally from the front wall 42, so that in combination with the spindle wall 36, the spindle 48 can be accommodated in a snug manner. As shown in FIG. 3, the beveled opening 28 is dimensioned such that an abutment is provided at the area where the spindle 48 is to be placed, and in one form of the invention, a spacer ring 46 is adapted to be placed there. The spacer ring 46 can be of any suitable material, plastic, metal or the like.

In any event, the spindle in FIG. 1 is shown as being an elongate cylindrical object having a groove 50 disposed along its longitudinal extent, and a plurality of transversely disposed retention slots 52 medial the longitudinal extent thereof. Let it be assumed that a major portion of the spindle 48 that extends within the housing interior 30 accommodates a conventional lock type cylinder, which in turn overlies the stem of a door knob. In some installations, the spindle 48 may not be required, if the external dimension of the door knob stem and lock cylinder that emanates from without the door is suitably dimensioned.

As shown in the drawings, the transversely disposed retention slots 52 are adapted to substantially be coplanar with the rear face 26 of the handle 12, in the following manner. A peripheral lip 44 is set within the handle 12, the lip 44 recessed within the rear face 26 thereof, the recess dimensioned to receive thereon a metal plate 54 dimensioned substantially the same as the opening for a smooth fit.

To fixedly retain the metal plate 54 on the opening on the rear face 26, a plurality of inwardly extending tabs 58 emanate from the lip 44 and are provided with suitable apertures to receive therewithin machine screws 56 similarly allowed to pass through apertures on the metal plate 54.

The metal plate 54 is provided with a cutaway so that the plate 54 is substantially crescent shaped, the cutaway being along a radius of curvature of the plate and including at least one tooth portion 55 adapted to be received within one of the retention slots 52 on the spindle 48. In addition, the slots 52 are shown as being along the top and the bottom of the spindle 48 and the cutaway portion of the metal plate 54 adjacent the two slots are suitably fashioned to frictionally engage the spindle 48 in substantially nonrotatable relative relationship.

When the device is assembled, it may be desirable to cover the metal plate 54 with a plastic trim cover 60 having substantially the same configuration as the metal plate, and for this purpose, further holes are provided in the metal plate 54 and along appropriate areas of the lip 44 so that a prong shaped snap fastener 62 (FIG. 3) can allow fixed placement of the plastic trim cover 60 thereon.

In addition, a spindle sleeve 64 can be associated with the exposed portion of the spindle 48 that emanates beyond the plastic trim cover 60, the spindle sleeve 64 having a radially and inwardly extending elongate tongue 66 adapted to reside within the longitudinal groove 50 disposed on the exterior portion of the spindle 48. The sleeve 64 addresses the plastic trim cover 60 by means of an outwardly flared beveled base 65.

As shown, the handle has a substantially massive handle body 12 and a considerably materially reduced moment arm 14, and the cylinder C is adapted to be offset in the handle body so as to be physical proximate to the moment arm 14 thereby defining a massive area remote from the moment arm 14 shown as the cast plastic 70 in FIG. 2. In use and operation, manipulation of the moment arm 14 as by rotation in the direction of the arrow A causes appropriate manipulation of the door latch through rotation of the spindle 48 and its connection to the cylinder and door stem (not shown) upon release of the moment arm's 14, the body of the handle rotates somewhat, but the additional mass disposed and opposing the moment arms action allows the mass 70 to assert additional influence on the return motion generated by the conventional springs that are provided in the latch thereby providing counter balancing.

Having thus described the invention, it should be apparent that numerous structural modifications are contemplated as being a part of this invention as set forth herein above and is defined hereinbelow by the claims.

I claim:

1. A door handle comprising in combination:
a handle means provided with means to receive a stem from a conventional door latch mechanism,
and counter balancing means integrally formed on said handle means to offset any rotational effect of said handle means which occurs when said handle means is rotated to latch or unlatch an associated door,
wherein said handle means is a cast structure having a hollowed out interior provided with a metal housing therewithin, said metal housing and interior hollow offset from a geometrical center of said handle.

2. The device of claim 1, wherein said metal housing has a wall portion substantially semi-cylindrical in shape and includes first and second segments defining chord like walls emanating inwardly and communicating with an integrally formed spindle wall, said metal housing further including an associated metallic front wall having a planar surface and arcuate configuration.

3. The device of claim 2, wherein an associated guide ridge emanates within said housing interior front wall, said guide ridge of arcuate configuration and when taken in association with said spindle wall serves as a guiding means for an associated spindle adapted to be slidably disposed therein.

4. The device of claim 3, wherein said spindle and said housing front wall having interposed therebetween an associated spacer ring.

5. The device of claim 4, wherein an end of said spindle adjacent said front wall allows communication with an opening on a front face of said handle.

6. The device of claim 5, wherein said spindle is an elongate cylindrical object having a longitudinally extending groove on one surface thereof.

7. The device of claim 6, wherein said spindle includes a plurality of retention slots medially disposed on said cylindrical surface and circumscribing portions thereof for reception therein of a plate means so as to affix said spindle in said housing, said plate means adapted to be fastened to and occlude said housing interior on a rear face of said handle.

8. The device of claim 7, wherein said spindle has a hollow interior adapted to receive therein a lock cylinder and the door stem of a conventional door latch mechanism.

9. The device of claim 8, wherein said handle is of substantially pentagonal configuration having said front face and said rear face and five peripheral faces defining said pentagonal structure including two planar faces from which extends outwardly an associated moment arm.

10. The device of claim 9, wherein said moment arm is provided at upper and lower termini thereof with boss means to provide purchase area for the hand of the user.

11. The device of claim 10, wherein said two substantially planar faces adjacent said moment arm each respectively communicate with two arcuate faces of said pentagonal handle, and a curved end face extending between said two arcuate faces defining five facets of said pentagonal handle.

12. The device of claim 11, wherein said plate means is a metallic plate adapted to be received upon said rear face of said handle by means of a peripheral recess including a lip integrally formed on said rear face and at least one downwardly extending tab member adapted to fixedly retain said metal plate by fastening means.

13. The device of claim 12, wherein said metal plate has an exterior surface upon which is disposed a plastic trim cover of similar configuration as said metal plate and affixed thereto by means of snap fasteners emanating from a trim cover face which abuts said metal plate, said snap fasteners extending through said aperatures provided on said metal plate, and a spindle sleeve adapted to overlie an exposed portion of said spindle, said spindle sleeve having cylindrical configuration and an inwardly directed longitudinal tongue slidably disposed within said groove of said spindle, a base of said spindle sleeve having a beveled base adapted to engage said plastic trim cover and a portion of said rear face of said handle.

14. A door handle comprising in combination:
a handle means adapted with means to receive a stem from a conventional door latch mechanism,
lever means extending from said handle means, and
counter balance means on said handle means to offset a rotational effect of said lever means,
wherein said lever means includes a moment arm emanating outwardly from said handle means, said lever means including boss means exposed on upper and lower terminal portions thereof adapted to provide a purchase area for a user, and said handle means includes a mass of plastic material having a hollowed interior including a metallic housing therewithin defining said stem reception means.

15. A door handle comprising in combination:
a handle means adapted with means to receive a stem from a conventional door latch mechanism,
lever means extending from said handle means, and
counter balance means on said handle means to offset a rotational effect of said level means, said stem reception means offset in said handle means to define said counter balance means,
wherein said lever means includes a moment arm emanating outwardly from said handle means, said lever means including boss means exposed on upper and lower terminal portions thereof adapted to provide a purchase area for a user, and said handle means includes a mass of plastic material having a hollowed interior including a metallic housing therewithin defining said stem reception means.

16. The device of claim 14, wherein said metallic housing includes means for supporting a spindle means therewithin, said spindle means adapted to engage a conventional lock cylinder, and in addition adatped to engage a stem from a conventional door latch mechanism, and means for sealing a housing area adjacent said spindle means which emanates outwardly from said handle.

17. The device of claim 15, wherein said metallic housing includes means for supporting a spindle means therewithin, said spindle means adapted to engage a conventional lock cylinder, and in addition adapted to engage a stem from a conventional door latch mechanism, and means for sealing a housing area adjacent said spindle means which emanates outwardly from said handle.

18. In a counterbalanced door handle, the combination of a handle mass having a moment arm and further having an interior portion formed therein, a housing carried by the interior portion of the handle mass, the housing including a curved wall, an arcuate guide ridge within the handle interior and confronting the curved wall of the housing, a spindle received between the arcuate guide ridge and the curved wall of the spindle, the spindle having at least one transversely-disposed retention slot formed therein intermediate the ends thereof, and a plate secured to the handle mass and having a tooth portion received in the retention slot in the spindle.

19. In a counterbalanced door handle, the combination of a handle mass having a moment arm and further having an interior portion formed between substantially parallel lateral faces of the handle mass, a housing within the interior portion of the handle mass and including a planar back wall, the housing further including a substantially semi-cylindrical portion, two inwardly-directed chordal wall portions joining the respective ends of the semi-cylindrical portion, and a curved back wall joining the respective ends of the chordal wall portions and disposed within the handle mass between the moment arm and the semi-cylindrical portion of the housing, spindle means received within the housing and supported by the curved back wall of the housing, means for retaining the spindle means within the handle mass, and the spindle means including a portion extending beyond the lateral face of the handle mass opposite to the planar back wall of the housing.

* * * * *